US005413225A

United States Patent [19]

Shields

[11] Patent Number: 5,413,225

[45] Date of Patent: May 9, 1995

[54] MAGNETIC SWEEPER

[75] Inventor: Charles W. Shields, Santa Barbara, Calif.

[73] Assignee: Shields Company, Ventura, Calif.

[21] Appl. No.: 230,495

[22] Filed: Apr. 20, 1994

[51] Int. Cl.[6] ..... B07C 7/04

[52] U.S. Cl. ..... 209/614; 209/215; 209/228

[58] Field of Search ..... 209/213, 215, 228, 229, 209/614; 15/105, 339

[56] References Cited

U.S. PATENT DOCUMENTS

| | | | |
|---|---|---|---|
| 1,212,870 | 1/1917 | Zolper | 209/215 X |
| 2,288,115 | 6/1942 | Soldanels | 209/215 X |
| 2,426,795 | 9/1947 | Sjostrom | 209/228 X |
| 2,648,434 | 8/1953 | Russell | 209/215 |
| 2,654,480 | 10/1953 | Stem | 209/215 |
| 2,693,279 | 11/1954 | Box et al. | 209/215 |
| 3,014,586 | 12/1961 | Ross | 209/215 |
| 3,206,783 | 9/1965 | Schwartz | 209/215 X |
| 3,377,641 | 4/1968 | McGregor | 209/215 X |
| 3,646,492 | 2/1972 | Westermann | 209/215 X |
| 3,956,111 | 5/1976 | Manfredi | 209/215 |
| 4,407,038 | 10/1983 | Haase | 209/215 X |
| 4,554,903 | 11/1985 | Matuki | 209/215 X |
| 4,904,376 | 2/1990 | Haase | 209/215 |
| 5,285,904 | 2/1994 | Haase | 209/215 |

FOREIGN PATENT DOCUMENTS

| | | | |
|---|---|---|---|
| 2249212 | 5/1975 | France | 209/215 |
| 2367474 | 6/1978 | France | 209/215 |
| 2069033 | 8/1981 | United Kingdom | 209/215 |

*Primary Examiner*—D. Glenn Dayoan
*Attorney, Agent, or Firm*—Marvin E. Jacobs

[57] ABSTRACT

A magnetic sweeper for collecting magnetically attractable debris from parking areas and the like using magnets in an aluminum tube. A collector plate is hinged to the tube in the magnetic zone so that the collector plate can be pivoted away from the magnet to release accumulated debris from the influence of the magnets. Steel latch plates on the collector plate hold it against the magnets in operation.

7 Claims, 1 Drawing Sheet

FIG. 1
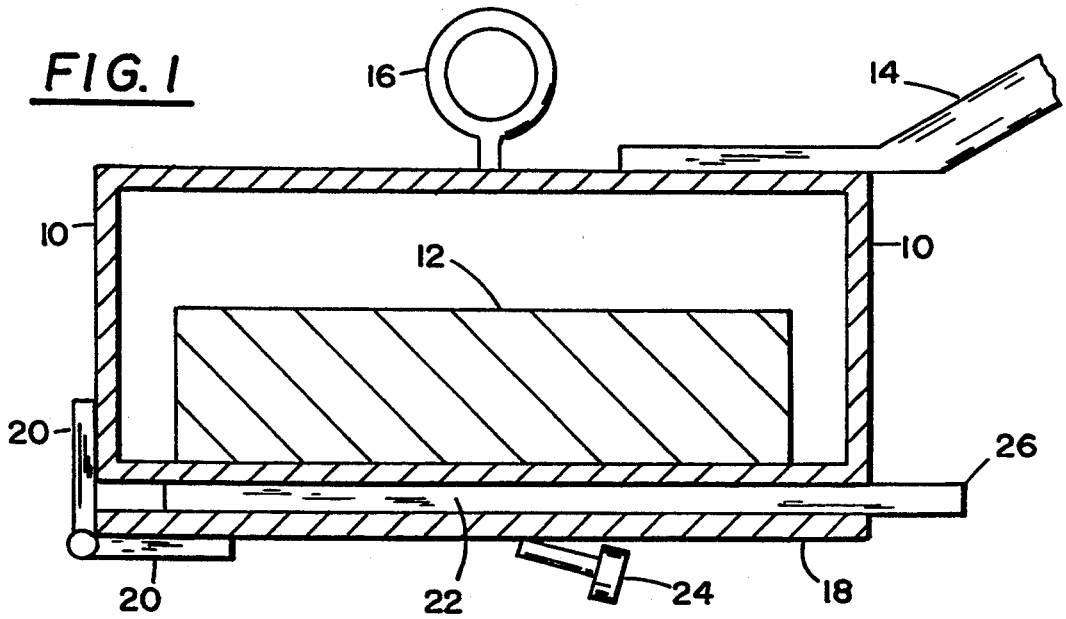
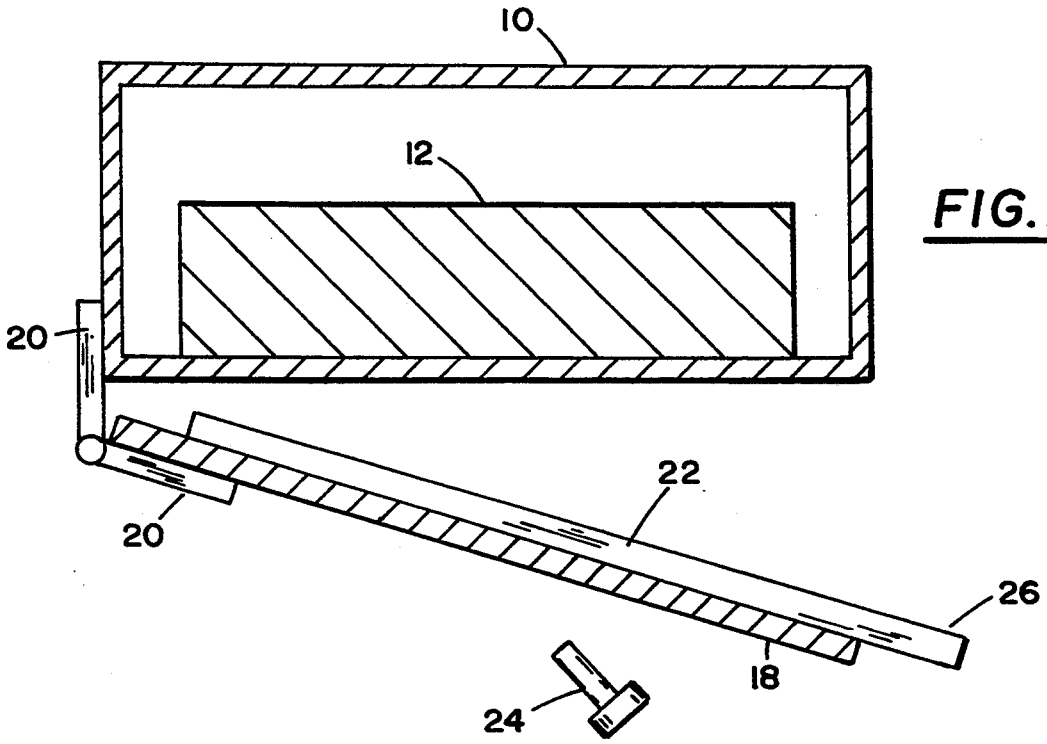
FIG. 2

MAGNETIC SWEEPER

TECHNICAL FIELD

This invention relates to sweepers or rakes that use a magnet to attract and pick up iron containing debris.

BACKGROUND OF THE INVENTION

The prior art recognizes magnetic sweepers and rakes for cleaning up stray ferrous objects from driveways, shop floors, parking lots, and construction sites. Objects such as nails can puncture tires, injure people, and, at airports, be ingested into jet engines causing costly damage. As the metal debris accumulates on the magnetic surface, it must be periodically cleaned off by hand. This is quite tedious since a good sweeper should have as strong a magnet as possible for good gathering and cleaning operation. However, this strong magnet holds tenaciously to the accumulated debris, making removal difficult. The present invention overcomes this problem.

STATEMENT OF THE INVENTION

Briefly, this invention incorporates a debris collecting plate located between the magnet and the collected debris which plate is movable away from the magnet so as to remove the debris from the influence of the magnet. The debris then simply drops off with a minimum of time and effort. The collecting plate is itself primarily held in place by the magnet, thus, eliminating the need for expensive mounting structure. Other benefits and advantages will become apparent from the following detailed description and the drawing referenced thereby.

BRIEF DESCRIPTION OF THE DRAWINGS

FIG. 1 is a cross sectional view of the magnetic sweeper of this invention with the debris collecting plate in the collecting position; and FIG. 2 is similar to FIG. 1 except with the collection plate opened to the debris release position.

DETAILED DESCRIPTION OF THE INVENTION

In figure 1, the magnetic sweeper of this invention is shown in section. A housing 10 is adapted to contain a plurality of magnets 12 mounted therewithin with a suitable adhesive or mechanical fastener. Typically, housing 10 may be two to five feet long in the direction perpendicular to the plane of the drawing. Housing 10 may be made from any material that protects magnets 12 including plastic or fiberglass. However, the preferred embodiment uses a heavy duty aluminum tube of about two by five inches as shown.

The sweeper can include wheels, not shown, fastened to the ends of housing 10 to allow it to be rolled over the floor using a handle 14. Alternatively, housing 10 can be hung by chain or cable connected to hooks 16 and to the chassis or bumper of a vehicle such as a forklift or baggage tractor so as to be carried just above a parking area or warehouse floor to attract and gather metal trash.

A collector plate 18 is positioned proximate housing 10 and magnets 12 with any suitable locating means such as one or more hinges 20. Hinges 20 may be mounted to housing 10 and collector plate 18 with adhesive, screws, bolts, or rivets. One or more steel latch plates 22 are mounted to collector plate 18, again with adhesive or mechanical fasteners. In operation, magnet 12 attracts latch plate 22 to the position shown in FIG. 1, thus, holding collector plate 18 close to magnet 12, and within the influence of magnet 12. In this position, magnet 12 attracts and picks up iron objects such as bolt 24 as housing 10 passes over the surface to be cleaned.

Latch plates 22 are attached so as to leave a projecting portion 26 extending out beyond the side of housing 10. Hence, when it is desired to clean off the accumulated debris, the operator can simply push down on portion 26, with his toe, for example, to swing collector plate 18 down and away as shown in FIG. 2. This moves the collector plate 18 outside of the influence of magnet 12 allowing the collected debris to simply drop off as shown by bolt 24 in FIG. 2.

Collector plate 18 is made from aluminum in the preferred embodiment for strength and durability. But, of course, plastics are an alternative here, as well. The specific arrangement and number of hinges 20 may vary as well as the arrangement and number of latch means 22. Since many variations are possible without departing from the spirit and scope of the invention, we intend to be limited only in accordance with the following claims and their equivalents.

I claim:

1. A magnetic sweeper for gathering magnetically attachable debris comprising in combination:

a housing;

magnet means in the housing;

a collecting plate hinged on the bottom of said housing with hinging means, said collecting plate swingable on said hinge means from a location within the influence of said magnet means to a location outside the influence of the magnet means; and latch plate means fastened to said collecting plate on the side of the collecting plate nearest to said magnet means, said latch plate means being of material attracted to said magnet means so as to hold said collecting plate close to said magnet means, said latch plate means having at least a portion extending beyond the side of said housing so as to provide a convenient projection for pushing said collecting plate downwards away from said magnet means.

2. The sweeper of claim 1 further including handle means mounted to the housing.

3. The sweeper of claim 1 further including means for mounting the housing to a vehicle.

4. The sweeper of claim 3 in which the mounting means includes a hook.

5. The sweeper of claim 1 in which said collector plate is formed of material that is not attractable by said magnet.

6. The sweeper of claim 5 in which the housing is formed of material which is not attracted to said magnet.

7. The sweeper of claim 6 in which the housing is formed of aluminum.

* * * * *